US006453580B1

(12) United States Patent
Lancon

(10) Patent No.: US 6,453,580 B1
(45) Date of Patent: Sep. 24, 2002

(54) CROSS-COUNTRY SKI BOOT

(75) Inventor: Bruno Lancon, Villy le Pelloux (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/719,249

(22) PCT Filed: Apr. 27, 2000

(86) PCT No.: PCT/FR00/01116

§ 371 (c)(1),
(2), (4) Date: Dec. 8, 2000

(87) PCT Pub. No.: WO00/69298

PCT Pub. Date: Nov. 23, 2000

(30) Foreign Application Priority Data

May 12, 1999 (FR) ..... 99 06257

(51) Int. Cl.[7] ..... A43B 5/04

(52) U.S. Cl. ..... 36/117.2; 36/118.2; 36/118.5; 36/118.8; 36/118.9

(58) Field of Search ..... 36/117.2, 118.2, 36/118.3, 118.4, 118.7, 118.8, 118.9

(56) References Cited

U.S. PATENT DOCUMENTS

| | | | | | |
|---|---|---|---|---|---|
| 4,138,828 | A | * | 2/1979 | Kubelka | 36/118.7 |
| 5,152,085 | A | | 10/1992 | Baggio et al | |
| 5,283,964 | A | | 2/1994 | Chemello | |
| 5,446,976 | A | | 9/1995 | Donnadieu et al. | |
| 5,588,229 | A | * | 12/1996 | Marmonier | 36/118.9 |
| 5,752,331 | A | * | 5/1998 | Perrissoud et al. | 36/118.3 |
| 5,784,810 | A | * | 7/1998 | Bonaventure | 36/118.2 |
| 5,806,212 | A | * | 9/1998 | Benoit et al. | 36/118.9 |
| 5,819,441 | A | * | 10/1998 | Perrissoud | 36/118.2 |
| 5,857,271 | A | * | 1/1999 | Pallatin | 36/118.4 |
| 5,901,470 | A | * | 5/1999 | Begey | 36/118.7 |
| 6,101,745 | A | * | 8/2000 | Grandin et al. | 36/118.7 |
| 6,131,313 | A | * | 10/2000 | Pierce et al. | 36/118.3 |

FOREIGN PATENT DOCUMENTS

| | | | | |
|---|---|---|---|---|
| CH | 675951 | | 11/1990 | |
| DE | 8020857 | | 11/1980 | |
| DE | 4125224 | A1 * | 4/1992 | 36/118.2 |
| DE | 29518019 | | 2/1996 | |
| EP | 0438079 | | 7/1991 | |
| EP | 0486801 | | 5/1992 | |
| EP | 0521283 | | 1/1993 | |
| EP | 0596281 | | 5/1994 | |
| EP | 0688510 | | 12/1995 | |
| WO | WO91/07889 | | 6/1991 | |
| WO | WO 94/27455 | * | 12/1994 | 36/118.7 |

* cited by examiner

*Primary Examiner*—Anthony D. Stashick
(74) *Attorney, Agent, or Firm*—Greenblum & Bernstein, P.L.C.

(57) ABSTRACT

A cross-country ski boot having a collar that is pivotally mounted by journals on an upper, and a device for retaining the collar that is active from a angular position and only in the front-to-rear direction by means of a fixed abutment located on the upper. The retaining device, located in the rear portion of the boot, includes a support mechanism that can be adjusted between two different positions with respect to the fixed abutment, one of the positions placing the support mechanism in cooperation with the latter and the other retracting it from the latter. The invention makes it possible to adapt a single type of cross-country ski boot for two different techniques such as the alternating step and the skating step.

21 Claims, 4 Drawing Sheets

0
1
2
4
6
8
10
11'
11
9
3
5
14
12
7
12'
α2

0
26
21
22'
22
20
21
22
22'
21
25
2
3
9
12
5
7
α2

CROSS-COUNTRY SKI BOOT

BACKGROUND OF THE INVENTION

1. Field of the Invention

The present invention relates to a cross-country ski boot that includes a collar mounted pivotally on an upper provided with a sole, and relates to a device for adjusting the rearward movement of the collar, from a predetermined initial angular position, so as to selectively enable the boot to be adapted for the alternating step technique or the skating step technique.

2. Description of Background and Relevant Information

The known cross-country ski boots of the aforementioned type generally have a relatively low upper that fits the foot, on which a collar, that surrounds the lower part of the leg, is pivotally mounted via assembling means allowing its removal. Thus, for the skating step technique, the collar is kept in place so as to provide rear support for the lower part of the leg, as well as a good lateral holding of the ankle and, conversely, for the alternating step technique, the collar is removed in order to offer as much freedom of movement to the articulation of the ankle as possible, especially in the direction of the front-to-rear extension. These means for assembling the collar on the upper therefore constitute the equivalent of an adjusting device, since they make it possible to selectively adapt a single type of cross-country ski boot for two different techniques of cross-country skiing. By way of example, one can cite the German Utility Design No. 295 18 019 and the European Patent Publication No. 486 801 that describe such cross-country ski boots.

Other cross-country ski boots are also known, whose pivoting collar can be adjusted with respect to the low upper in order to offer more or less freedom of movement to the articulation of the ankle in the direction of the front-to-rear extension. The International Patent Publication No. WO 91/07889 describes such a boot and especially shows an adjusting device which, located in the area of the pivoting axis of the collar on the low upper, makes it possible to provide the collar with more or less movement in the front-to-rear direction.

To this end, a fixed abutment affixed to the collar cooperates, in the area of the articulation of the latter, with an abutment that can be adjusted in position on the low upper of the boot. As a result of this construction, it is the modifying of the position of the adjustable abutment on the low upper that determines the pivoting limit of the collar in the front-to-rear direction. Therefore, the articulation of the ankle can be provided with sufficient freedom of movement in the front-to-rear direction for the alternating step technique, despite the presence of the collar.

Moreover, still by means of the adjustable abutment, it is possible to limit the rearward tilting of the collar so as to provide rear support to the lower part of the leg, which is useful for bringing back the ski when propulsion ceases during the skating step technique. The adjusting device used in the area of the articulation of the collar therefore makes it possible, as in the preceding examples, to adapt a single type of cross-country ski boot for two different techniques of cross-country skiing, without dismounting the collar.

Conversely, it has the disadvantage of requiring the use of materials with high mechanical properties to obtain the various constituent parts of the adjusting device, as well as those of the collar and of the upper. Indeed, since the collar functions according to the principle of a lever, the forces applied thereto are multiplied considerably in the area of the abutments, because the latter are very close to its pivoting axis. Therefore, they, as well as the parts that carry them, must be very resistant, which results in a boot whose general structure is relatively rigid. Moreover, the boot is uncomfortable because the cooperation of the abutments with one another always translates into a firm support that is reflected as an impact on the rear portion of the lower part of the leg, especially during the extension of the foot.

Known cross-country ski boots that are more specifically designed for the skating step technique, such as that described in the Swiss Patent No. 675 951, can still be used for the alternating step technique. According to this document, the cross-country ski boot has a collar that is pivotally mounted by journals on an upper provided with a sole and a collar retaining device active from a predetermined angular position of the collar with respect to the upper, and only in the front-to-rear direction. To this end, the device is positioned in the rear portion of the boot and comprises, on the upper, a fixed abutment that is functional only in the top-down direction with the lower rear edge of the collar. In this way, the collar is stopped in rearward pivoting by the fixed abutment of the upper and remains free of pivoting forwardly. This construction therefore enables the bending movement of the ankle during the "regrouping" phase in executing the alternating step. Conversely, for such use, the freedom of movement of the ankle in the front-to-rear direction is very limited because of the blocking of the collar in rearward pivoting. As a result of this limitation, the user is forced to perform low amplitude steps, otherwise, the rear portion of the lower part of his leg is subject to painful pressures in the contact zone with the upper edge of the collar.

In fact, it is noted that even by making careful movements, repeating alternating steps nevertheless causes irritation, heating, pain, etc., which is why these boots are seldom used for the alternating step.

A partial solution to this dual purpose use of a cross-country ski boot, which does not comprise an adjusting device to optimize its adaptation to the alternating step or to the skating step, is presented with the boot that is taught in the European Patent Publication 596 281. Indeed, in this boot, the blocking of the collar in rearward pivoting is progressive due to the use of an elastic shock absorbing element between the collar and the upper which serves as a support means, and this element can be provided to be more or less flexible. The support on the upper edge of the collar is therefore more flexible, more absorbed than in the cross-country ski boots described in Swiss Patent 675 951, which avoids the impacts with the rear portion of the lower part of the leg. The fact remains true that over time, repeating the alternating steps generates irritation, heating, etc., due to the fact that the collar cannot tilt freely toward the rear, i.e., without encountering the elastic resistance of the support means. Finally, it is noted that the use of these boots having rear support absorption, as for the preceding boots, remains truly occasional in the alternating step technique because they cause the same discomforts over time.

SUMMARY OF THE INVENTION

An object of the invention is to propose a cross-country ski boot having a pivoting collar that can be easily adapted to assume the specific characteristics of the alternating step and skating step techniques, especially without it being necessary to dismount the collar and without intervening in the area of the pivoting axis thereof.

In particular, the invention aims at using an adjustable device for retaining the collar that is capable of maintaining the latter in the front-to-rear direction, in a predetermined angular position with respect to the upper adapted for the skating step technique, on the one hand, and of releasing the collar in rearward pivoting to enable the alternating step technique, on the other hand, whether or not the collar comprises an elastic shock absorbing element interacting between it and the upper.

More specifically, the device is provided to be capable of releasing the collar in rearward pivoting, over a pivoting amplitude that is at least sufficient to enable the extension of the ankle and of the foot of the back leg when thrust ceases in the alternating step technique. Conversely, the retaining device is also provided to be capable of blocking the collar in rearward pivoting, so as to provide the lower part of the leg with rear support, which is useful for bringing back the ski when the propulsion ceases in the skating step technique.

To achieve this object, the cross-country ski boot has a collar that is pivotally mounted by journals on an upper, and a device for retaining the collar that is active from a predetermined angular position and only in the front-to-rear direction by means of a fixed abutment located on the upper, the device being positioned in the rear portion of the boot. The retaining device comprises a support mechanism that can be adjusted between two different positions with respect to the fixed abutment, one of the positions bringing the support mechanism to cooperate with the abutment, and the other position retracting it from the abutment.

With these arrangements, it is easy to adapt the boot for the alternating step or the skating step technique, because it suffices to displace the support mechanism with respect to the abutment, without any other maneuver to modify/adjust the amplitude of the possible rearward movement of the collar with respect to its initial angular position. Moreover, due to the fact that the support mechanism and the abutment are arranged in the rear portion of the boot, therefore at a distance from the journals of the collar, it is not necessary to use materials having high mechanical properties to obtain the various constituent parts of the adjusting device. Indeed, in view of the distance of the adjusting device with respect to the journals of the collar, the latter has a lesser lever effect than in the case of the known boots which comprise an adjusting device located in the area of the journals, as disclosed previously with reference to the document WO 91/07889.

According to a first embodiment of the invention, the cross-country ski boot comprises an elastic shock absorbing element inserted between the collar and the upper in the rear portion of the boot, and it is on this elastic element that the adjustable support mechanism of the retaining device is fixed. This elastic element can be independent of the collar, or affixed thereto, as taught in the document EP 0 596 281.

In a preferred construction, the elastic shock absorbing element is constituted by a flexible blade that extends over and opposite the fixed abutment by surrounding the rear portion of the upper, and whose ends are affixed to the collar in the area of the journals thereof on the upper; the adjustable support mechanism is, in this case, mounted on the flexible blade so as to be approximately centered with respect to the journals of the collar.

According to another embodiment, the cross-country boot comprises a collar with no shock absorbing means between it and the upper, the adjustable support mechanism of the retaining device then being directly fixed on the rear portion of the collar.

Regardless of the structure of the collar of the boot, i.e., with or without an elastic shock absorbing element, the adjustable support mechanism can be obtained in various ways, and its functioning can be carried out by pivoting, sliding, tilting, etc.

According to one example, the adjustable support mechanism is constituted by a pivoting piece that can be tilted between two angular positions of approximately 180°. This piece is made with an off-centered portion having a shaped end that is adapted to cooperate with the fixed abutment located on the upper in an angular position, and to retract from this fixed abutment in the other angular position, thus releasing the collar in rearward pivoting.

According to another example, the adjustable support mechanism is constituted by a movable lengthening piece that is guided in the rear portion of the collar, this lengthening piece being engaged above the fixed abutment of the upper for the adjusting position corresponding to the blocking of the collar in rearward pivoting, and being disengaged from the fixed abutment for the other adjusting position that corresponds to the rearward release of the collar. The movable lengthening piece can advantageously constitute the extension of the free end of a flexible tongue that is rotatably fixed on the rear portion of the collar, and its guiding can be carried out through an opening located in correspondence with the fixed abutment. The disengagement of the lengthening piece with respect to the latter then occurs by retraction of the flexible tongue, followed by a lateral rotation with respect to the guiding opening.

The movable lengthening piece can also be slidably mounted in a slider that confines it in the rear portion of the collar which carries it. In this case, a maneuvering member that can be accessed easily from outside the collar is provided to be capable of displacing it between two extreme adjusting positions, in one of which it is engaged above the fixed abutment and in the other of which it is disengaged therefrom.

In the example of construction of the collar with an elastic shock absorbing element between it and the upper, the adjustable support mechanism can be constituted by a removable piece that is fixed by elastic pinching on this shock absorbing element; in order to present two possible adjusting positions, this removable piece can be rotated at 180° and is obtained approximately in the form of a U, one vertical arm of which is markedly thicker than the other. In this way, the thickest vertical arm cooperates with the fixed abutment located on the upper in an adjusting position of the support means and retracts from this abutment by a 180° rotation of the latter by placing the thinnest vertical arm of the U opposite the abutment for the other adjusting position. In fact, one plays with the difference in the thickness of the vertical arms of the U to cause the support mechanism to cooperate or not cooperate with the fixed abutment.

According to an alternative embodiment of the invention, the adjustable support mechanism is constituted by an elastic shock absorbing element interacting between the collar and the abutment of the upper, on the one hand, and by a lever-cable tensioning system capable of retracting the elastic element from the fixed abutment by separating it therefrom by a certain distance so as to provide the collar with a possibility of reward tilting of a certain amplitude, and whose limit is determined by the recovery of the support of the shock absorbing element on the abutment.

In this alternative embodiment, the elastic shock absorbing element can consist of an elastic blade which, fixed to the collar in the area of its journals on the upper, surrounds the rear portion of the latter.

BRIEF SUMMARY OF THE DRAWINGS

The invention will be better understood from the description that follows, with reference to the annexed drawings showing, by way of example, a plurality of embodiments.

DETAILED DESCRIPTION OF THE INVENTION

Figure 1:
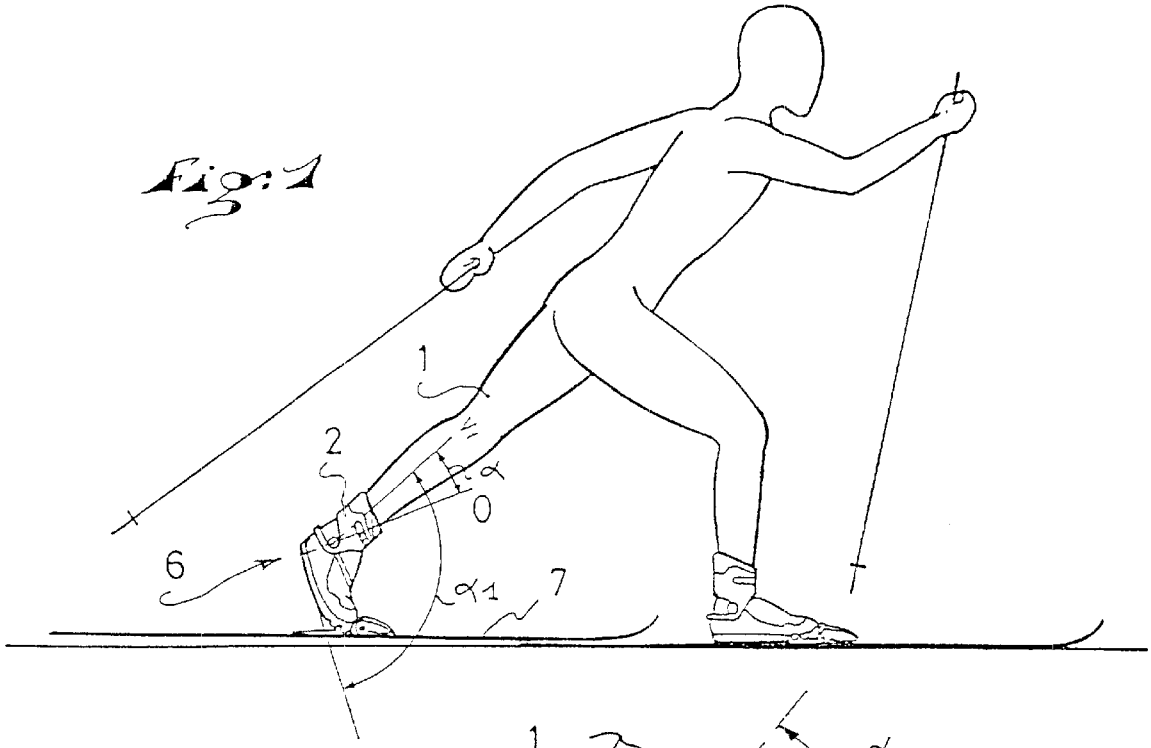
FIG. 1 schematically shows a cross-country skier in the end of a thrust, or propulsion, motion in the alternating step technique, clearly showing the extension of the ankle and of the foot on the back leg, and the reflection of these movements on the constituent parts of the boot.
Figure 2:
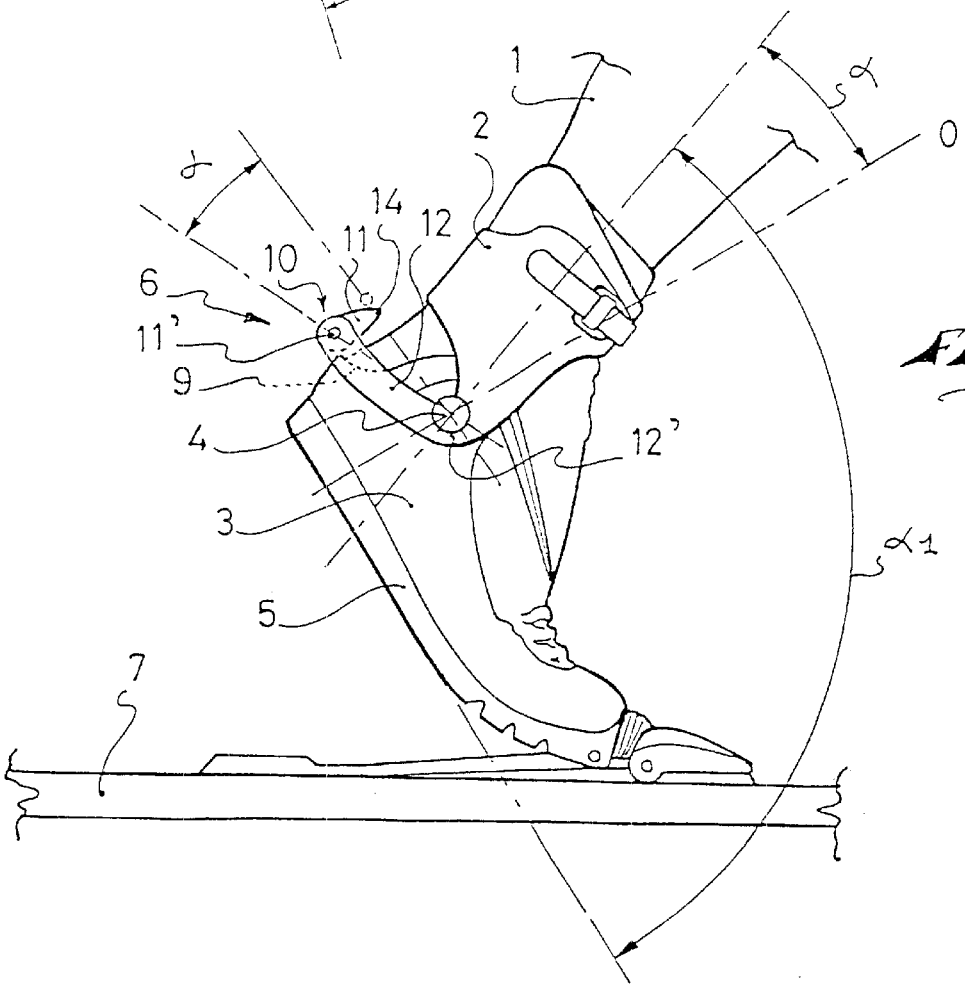
FIG. 2 shows in more detail the functioning of the boot in the end of thrust motion where the adjustable support mechanism of the retaining device of the collar is retracted from the fixed abutment of the upper.
Figure 3:
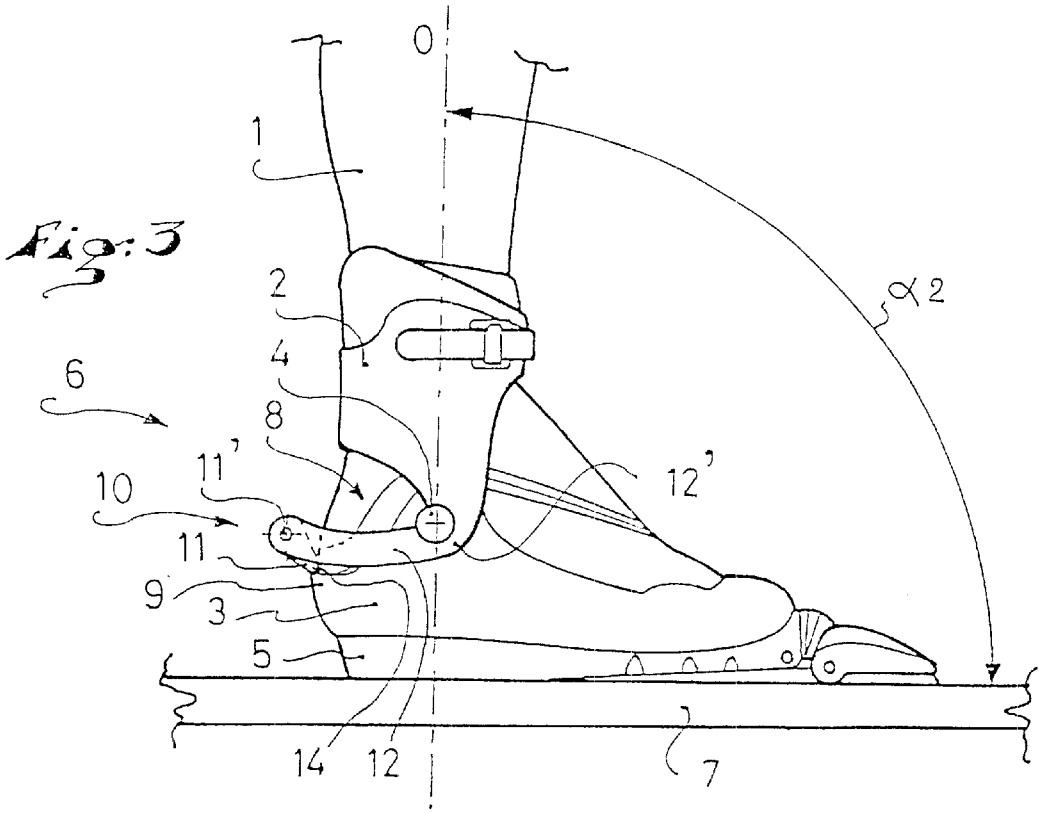
FIG. 3 shows the same boot as that of FIG. 2 in the initial position and adapted for the skating step technique, the adjustable support mechanism of the retaining device of the collar cooperating with the fixed abutment of the upper.

As explained above, cross-country skiing using the alternating step technique requires that the articulation of the ankle have great freedom of movement, whereas in the skating step technique, it is advantageous to limit the amplitude of this movement. More specifically, in the skating step technique, the collar must provide the lower part of the leg with rear support, which is useful for bringing back the ski 7 at the end of the propulsion phase, whereas in the alternating step technique, as shown in FIG. 1, the collar 2 of the boot 6 must enable the extension of the ankle and of the foot of the back leg 1 at the end of the thrust, therefore without rear support for the lower part of the leg. This extension of the ankle and of the foot translates on the boot 6, as shown in FIGS. 2 and 3, by the pivoting of the collar 2 in the front-to-rear direction, according to an angular amplitude $\alpha$, from its initial position indicated by the axis line 0 with respect to the upper 3 and its sole 5. In fact, this value $\alpha$, which is also variable since it results from the movements of the skier, corresponds to the difference in angle between the maximum extension angle $\alpha 1$ and the angle $\alpha 2$ of the initial position 0 of the collar 2, by turning on its journals 4 located substantially in correspondence with the skier's ankle. In FIG. 2 it can be seen that the sole 5 of the boot is flexible along its length, i.e., enabling the sole to flex, to permit the skier to raise his heel as the rear leg reaches the end of the thrust position, shown in FIG. 2, from the initial position shown in FIG. 3, in which the heel is supported upon the ski.

To enable this adaptation of the boot 6 to one and the other of the mentioned cross-country skiing techniques, a retaining device 10 of the collar 2, positioned in its rear portion 8, is provided with a support mechanism 11 that can be adjusted between two different positions, and the upper 3 is provided with a fixed abutment 9. The support mechanism 11 and the fixed abutment 9 are opposite one another such that one of the positions places the support mechanism 11 in cooperation with the abutment 9, as illustrated in FIG. 3, and that the other position retracts it from the abutment 9, as shown in FIG. 2.

In this example of construction, the cross-country ski boot has a collar 2 comprising an elastic shock absorbing element 12 that extends in the rear portion 8 of the boot and the adjustable support mechanism 11 is mounted thereon. This element 12 is constituted by a flexible blade 12 that surrounds the rear portion 9 and whose ends 12' are affixed to the collar 2 in the area of the journals 4 of the latter. Preferably, the support mechanism 11 is approximately centered on the flexible blade 12 with respect to the ends 12' of the latter and of the journals 4 of the collar 2; in this way, the support mechanism 11 and the fixed abutment 9 are in the farthest position possible from the journals 4, which minimizes the "lever effect" of the collar 2 and thus of the forces transmitted, and renders the use of ordinary materials, such as plastic, for example, possible.

Different constructions of the support mechanism 11 are possible. Thus, in this first example, the support mechanism 11 is constituted by a pivoting piece 11 which, mounted on an axle 11', can be tilted between two angular positions of approximately 180°, each of these positions determining a possibility of pivoting of the collar 2. To this end, the pivoting piece 11 is obtained with an off-centered portion whose shaped end 14 can be directed over and against the fixed abutment 9 of the upper 3. In this position, shown in FIG. 3, the pivoting piece 11 is blocked in pivoting over itself when it is biased rearwardly by the collar 2, because it hangs between its axle 11' and the abutment 9. The collar 2 is therefore stopped in rearward tilting by the pivoting piece 11. Conversely, in a forward tilting, the collar 2 is not hindered or blocked by this pivoting piece 11, because the end 14 of the latter automatically moves away from the fixed abutment 9 by following the movement of the collar 2 which drives along with it the flexible blade 12 constituting the elastic shock absorbing element.

In the other adjusting position of the support element 11, i.e., of the pivoting piece 11, the end 14 of the off-centered portion is pivoted toward the top of the collar 2. In this way, the pivoting piece 11 is completely retracted from the abutment 9 and releases the collar 2 from any rearward blocking, at least over an angular amplitude $\alpha$ that is sufficient for the alternating step technique.

Figure 4:
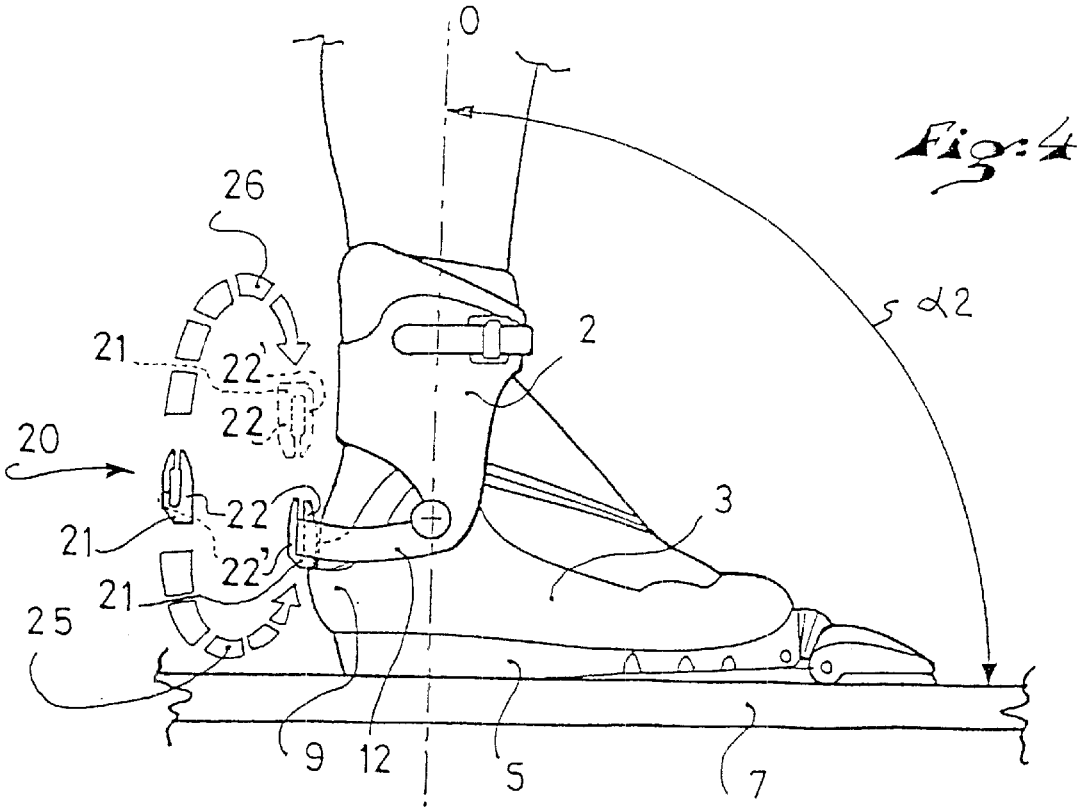
FIG. 4 shows another embodiment of the adjustable support mechanism of the retaining device as applied to a boot of the same type as that of FIGS. 1–3.

According to another construction, shown in FIG. 4, the retaining device 20 has an adjustable support mechanism constituted of a removable piece 21 that is fixed by elastic pinching on the elastic shock absorbing element 12, i.e., the flexible blade 12, which is a part of the collar 2. This piece 21, obtained in the form of a U, one vertical arm 22 of which is markedly thicker than the other 22', is provided to be mounted on the flexible blade 12 in the manner of a clamp. To block the collar 2 rearwardly, the removable piece 21 is fixed base up as indicated by the arrow 25, such that it is the end of its thickest arm 22 that cooperates with the abutment. In this way, even if the forces transmitted by the collar 2 to the flexible blade 12 are substantial, the U-shaped removable piece 21 remains fixed on the latter without risk of disengagement.

Conversely, for the release position of the rear support of the collar 2, the removable piece 21 is fixed top down on the flexible blade 12, as indicated by the arrow 26, because there are no forces that tend to disengage it. Thus, in this mounting position, it is the thinnest arm 22' of the U-shaped profile of the removable piece 21 that is directed on the side of the fixed abutment 9, because it remains out of the reach of the latter.

Figure 5:
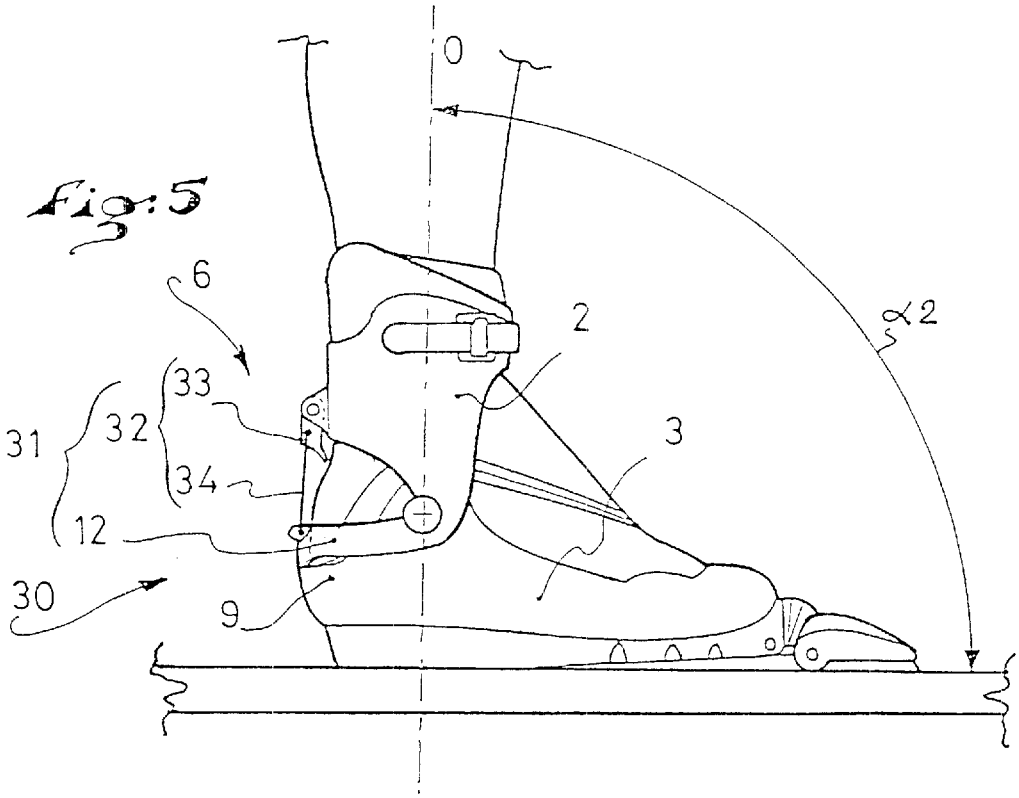
FIGS. 5 and 6 show another embodiment of the retaining device of the collar, in which an elastic shock absorbing element interacting between the upper and the collar is used to release the latter in rearward pivoting.
Figure 6:
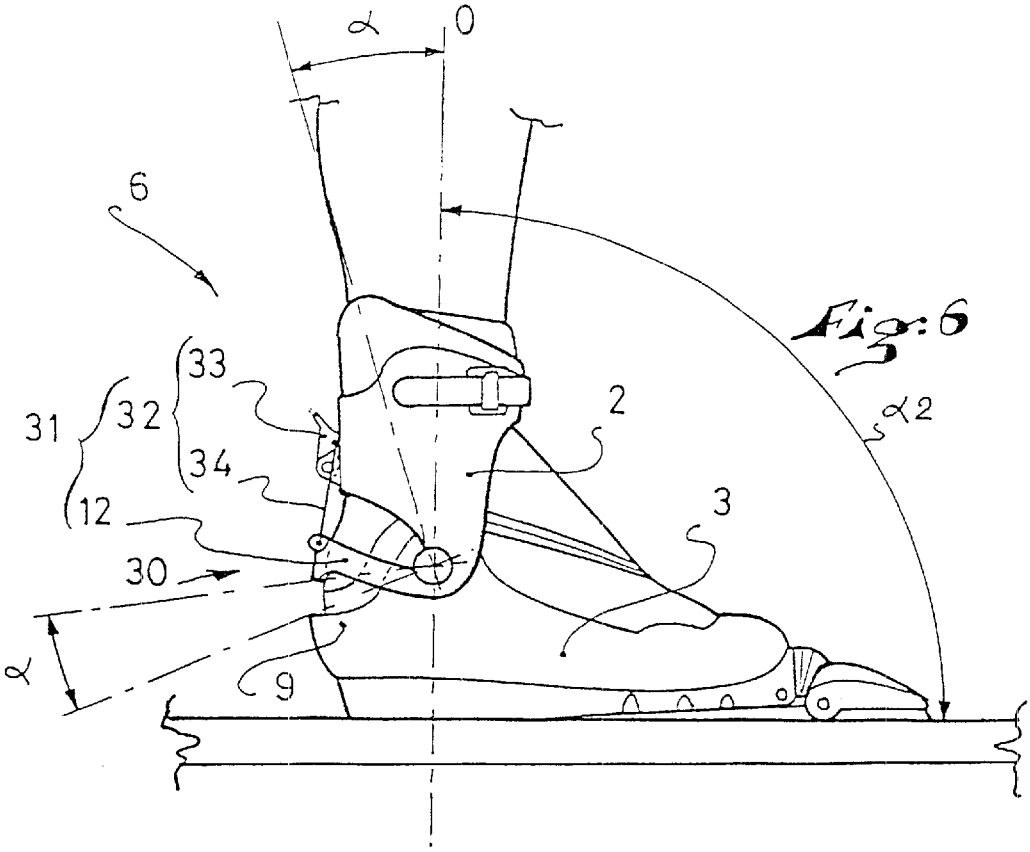

According to an alternative embodiment, shown in FIGS. 5 and 6 the retaining device 30 has an adjustable support mechanism 31 that is in fact constituted of the shock absorbing element 12 as well as a specific arrangement such as a tensioning system 32 comprising a lever 33 and a cable 34 fixed on the collar 2 of the boot 6 and connected to the shock absorbing element 12 formed by the flexible blade. To obtain two stable adjustable positions, the lever 33 is journalled with respect to the hooking points of the cable 34 so as to function as a so-called "knuckle joint" movable hinge. Thus, in its relaxed position, the tensioning system 32, as shown in FIG. 5, allows the flexible blade 12 to take support on the fixed abutment 9 of the upper 3 when the collar 2 is at an inclination angle $\alpha 2$ corresponding to its initial position 0. Conversely, in its tensioned position shown in FIG. 6, the tensioning system 32 pulls on the cable 34 and therefore retracts the flexible blade 12 from the fixed abutment 9 by a certain distance corresponding to the upward displacement of the cable 34 that is caused by means of the lever 33. The flexible blade 12 thus separated from the fixed abutment 9 provides the collar 2 with a possibility of rearward tilting over a certain angular amplitude $\alpha$ with respect to its initial position 0. This titling possibility reaches its limit when said blade 12 retakes support on the abutment 9, because in this alternative embodiment, the adjustable support mechanism 31 does not retract completely with respect to the latter.

Figure 7:
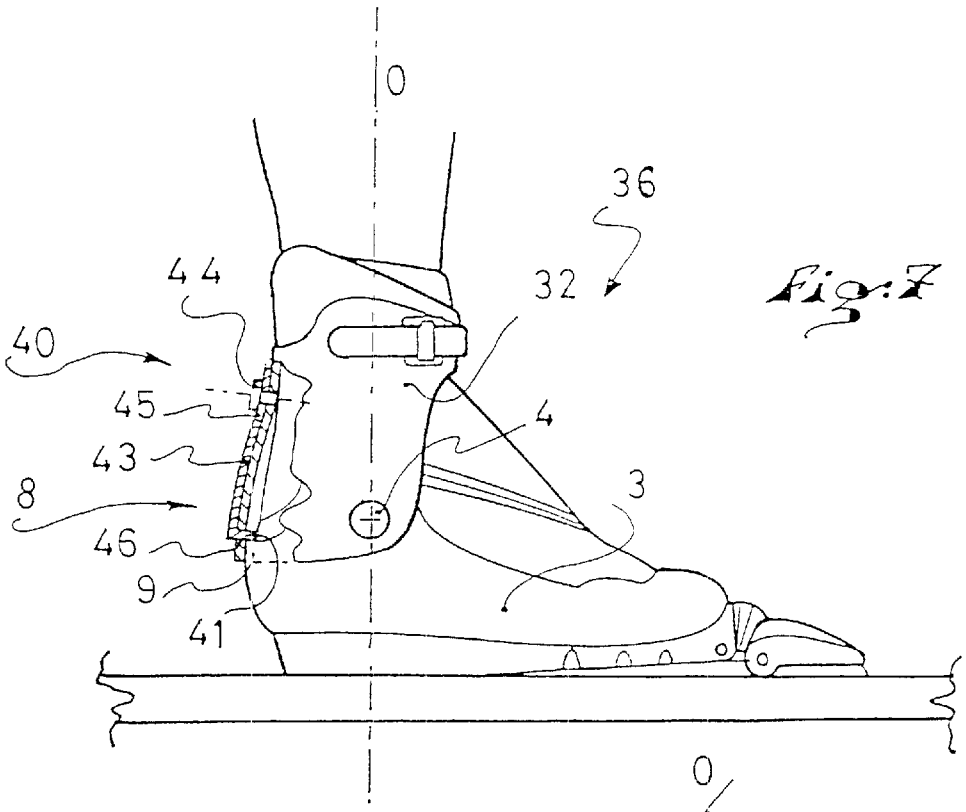
FIGS. 7 and 8 show another example of embodiment of the adjustable support mechanism used on a boot comprising no elastic shock absorbing element arranged between the collar and the upper.
Figure 8:
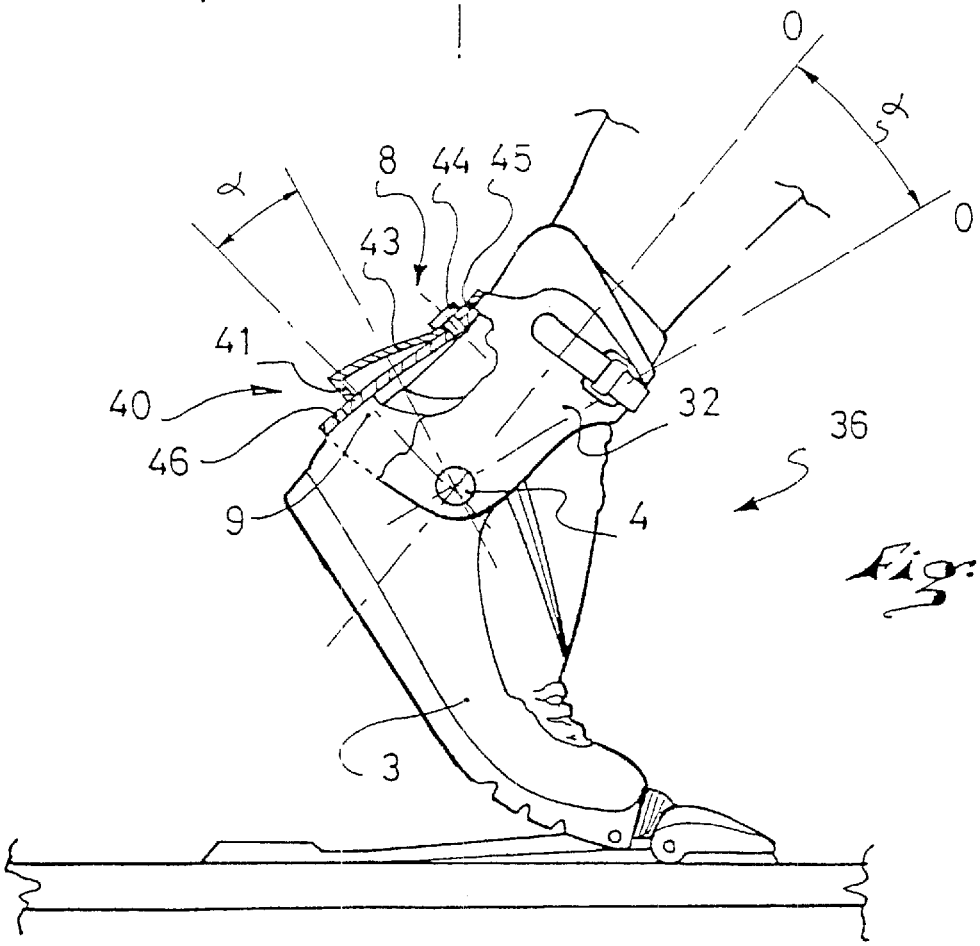

The exemplary embodiments that have just been described with reference to the preceding FIGS. 1–6 are applied to a type of boot 6 provided with an elastic shock absorbing mechanism 12 interacting between the collar 2 and the upper 3, but can of course be adapted to another type of cross-country boot with no such shock absorbing mechanism, as shown in FIGS. 7 and 8. In this cross-country ski boot 36, the collar 32 is mounted as previously on an upper 3 via journals 4 located preferably in the zone corresponding to the skier's ankle, and a retaining device 40 is positioned in its rear portion 8.

This retaining device 40 is provided with an adjustable support mechanism 41 constituted of a movable lengthening piece guided in the rear portion 8 of the collar 32, through a guiding opening 46 in correspondence with the fixed abutment 9. When the cross-country boot 36 is adapted for the skating step technique, shown in FIG. 7, the lengthening piece 41 is engaged above the fixed abutment 9. In this way, the collar 32 is blocked in rearward pivoting while remaining free to pivot forwardly. In its other adjusting position, shown in FIG. 8, the lengthening piece 41 of the retaining device 40 is completely retracted from the fixed abutment 9, which enables the collar 32 to tilt freely toward the rear over a certain angular amplitude $\alpha$ from its initial position 0. The boot 36 is thus well adapted to enable the extension of the skier's ankle and foot in the alternating step technique.

According to a construction detail, the lengthening piece 41 extends the end of a flexible blade 43 that is fixed rotatably and slidably on the rear portion of the collar 32 via an assembly axis 44 and an oblong slot 45 obtained in the flexible blade 43. In this way, the disengagement of the lengthening piece 41 with respect to the fixed abutment 9 occurs by retraction of the free end of the flexible tongue 43, followed by an upward sliding of the latter.

It can also be envisioned to make the flexible tongue 43 merely rotatable on its assembly axis 44. The disengagement of the lengthening piece 41 then occurs by retraction of the free end of the flexible tongue 43, then by lateral rotation with respect to the guiding opening 46.

It is to be understood that a maneuvering member that can be accessed from the end of the collar 32 can advantageously be associated with the movable lengthening piece 41 or with the flexible blade 43 to facilitate the grip.

Furthermore, other embodiments for implementing of the movable lengthening piece 41 are possible. For example, the lengthening piece 41 can be mounted slidably in a slide obtained in the rear portion of the collar 32, such that it can be engaged above the fixed abutment 9 for one position, and disengaged therefrom for another position.

What is claimed is:

1. A cross-country ski boot comprising:

a sole having a front end and a rear end, said sole being a flexible sole to enable flexing of said sole between said front and rear ends as said rear end is raised during skiing;

an upper extending upwardly from said sole;

a collar mounted pivotally by journals on said upper; and a retaining device for retaining said collar, said device being active from a predetermined angular position, and only in a front-to-rear direction by means of a fixed abutment located on said upper, said device being positioned in a rear portion of the boot, wherein said retaining device comprises a support mechanism, said support mechanism being adjustable between two different positions with respect to said fixed abutment, a first of said two different positions placing said support mechanism in cooperation with said fixed abutment and a second of said two different positions retracting said support mechanism from said fixed abutment, said two different positions of said support mechanism corresponding, respectively, to two different skiing positions of said collar.

2. A cross-country ski boot according to claim 1, wherein said adjustable support mechanism is fixed on an elastic shock-absorbing element, said shock-absorbing element being a part of said collar and extending in the rear portion of the boot opposite said fixed abutment located on said upper of the boot.

3. A cross-country ski boot according to claim 2, wherein said adjustable support mechanism is constituted by a pivotal piece that can be tilted between two angular positions of approximately 180°, said pivotal piece being obtained with an off-centered portion having a shaped end adapted to cooperate with said fixed abutment located on said upper in one angular position, and to retract from said fixed abutment in the other angular position, thus releasing said collar in rearward pivoting.

4. A cross-country ski boot according to claim 1, wherein said adjustable support mechanism is constituted by a movable lengthening piece that is guided in the rear portion of said collar, said lengthening piece being engaged above said fixed abutment of said upper for the adjusting position corresponding to the blocking of said collar in rearward pivoting, and being disengaged from said fixed abutment for the other adjusting position that corresponds to the rearward release of said collar.

5. A cross-country ski boot according to claim 4, wherein said movable lengthening piece extends the free end of a flexible tongue fixed rotatably on the rear portion of said collar, and wherein said movable lengthening piece is guided through an opening in correspondence with said fixed abutment located on said upper, the disengagement of said lengthening piece with respect to said abutment occurring by retraction of said tongue, followed by lateral rotation with respect to said guiding opening.

6. A cross-country ski boot according to claim 4, wherein said movable lengthening piece comprises a maneuvering member that can be accessed from outside said collar and slides in a slide obtained in the rear portion of said collar between two extreme positions, in one of which said maneuvering member is engaged above said fixed abutment and in the other of which said maneuvering member is disengaged therefrom.

7. A cross-country ski boot, said boot comprising:

a sole;

an upper extending upwardly from said sole;

a collar mounted pivotally by journals on said upper;

a retaining device for retaining said collar, said device being active from a predetermined angular position, and only in a front-to-rear direction by means of a fixed abutment located on said upper, said device being positioned in a rear portion of the boot, wherein said retaining device comprises a support mechanism, said support mechanism being adjustable between two different positions with respect to said fixed abutment, a first of said two different positions placing said support mechanism in cooperation with said fixed abutment and a second of said two different positions retracting said support mechanism from said fixed abutment, said two different positions of said support mechanism corresponding, respectively, to two different skiing positions of said collar;

wherein said adjustable support mechanism is fixed on an elastic shock-absorbing element, said shock-absorbing element being a part of said collar and extending in the rear portion of the boot opposite said fixed abutment located on said upper of the boot; and wherein said elastic shock-absorbing element is constituted by a flexible blade that extends over and opposite said fixed abutment by surrounding the rear portion of said upper, and whose ends are affixed to said collar in an area of said journals of said collar on said upper, said adjustable support mechanism being mounted on said blade so as to be approximately centered with respect to said journals of said collar.

8. A cross-country ski boot according to claim 7, wherein said adjustable support mechanism of said retaining device is constituted by said flexible blade, said flexible blade having ends affixed to said collar, and by a tensioning system comprising a lever and a cable capable of retracting said flexible blade from said fixed abutment by separating said flexible blade from said fixed abutment by a certain distance, so as to provide said collar with a possibility of rearward tilting whose limit is determined by the recovery of the support of said flexible blade on said abutment.

9. A cross-country ski boot according to claim 7, wherein said sole includes a front end and a rear end, said sole being a flexible sole to enable flexing of said sole between said front and rear ends as said rear end is raised during skiing.

10. A cross-country ski boot, said boot comprising:

a sole;

an upper extending upwardly from said sole;

a collar mounted pivotally by journals on said upper;

a retaining device for retaining said collar, said device being active from a predetermined angular position, and only in a front-to-rear direction by means of a fixed abutment located on said upper, said device being positioned in a rear portion of the boot, wherein said retaining device comprises a support mechanism, said support mechanism being adjustable between two different positions with respect to said fixed abutment, a first of said two different positions placing said support mechanism in cooperation with said fixed abutment and a second of said two different positions retracting said support mechanism from said fixed abutment, said two different positions of said support mechanism corresponding, respectively, to two different skiing positions of said collar;

wherein said adjustable support mechanism is fixed on an elastic shock-absorbing element, said shock-absorbing element being a part of said collar and extending in the rear portion of the boot opposite said fixed abutment located on said upper of the boot; and wherein said adjustable support mechanism is constituted of a removable piece that is fixed by elastic pinching on said elastic shock absorbing element which is a part of said collar, said removable piece being capable of rotating at 180° on said elastic element and being approximately in the form of a U, one vertical arm of which, markedly thicker than the other, cooperates with said fixed abutment located on said upper in one adjusting position of said support mechanism, and retracts from said abutment by a 180° rotation of said support mechanism by placing the thinnest vertical arm of the U opposite said abutment for the other adjusting position.

11. A cross-country ski boot according to claim 10, wherein said sole includes a front end and a rear end, said sole being a flexible sole to enable flexing of said sole between said front and rear ends as said rear end is raised during skiing.

12. A cross-country ski boot comprising:

a sole having a front end and a rear end, said sole being flexible to enable flexing of said sole between said front and rear ends as said rear end is raised during skiing;

an upper extending in a longitudinal direction between a front and a rear of said upper, said rear of said upper including a fixed abutment;

a collar extending upwardly from said upper, said collar being mounted for angular movement relative to said upper in a front-to-rear direction and in a rear-to-front direction; and a retaining device for opposing movement of said collar in said front-to-rear direction at two discrete skiing positions of said collar, said retaining device comprising a support mechanism, said support mechanism being adjustably movable between two different positions relative to said fixed abutment of said rear of said upper;

a first of said two different positions of said support mechanism placing said support mechanism in cooperation with said fixed abutment of said rear of said upper and thereby placing said collar in a first of said discrete skiing positions; and a second of said two different positions of said support mechanism retracting said support mechanism from cooperation with said fixed abutment of said rear of said upper and thereby placing said collar in a second of said discrete skiing positions, said second of said discrete skiing positions of said collar being rearward of said first of said discrete skiing positions of said collar.

13. A cross-country ski boot according to claim 12, wherein:

said retaining device is active for opposing movement of said collar only in said front-to-rear direction from either of said two discrete skiing positions of said collar.

14. A cross-country ski boot according to claim 12, wherein:

said collar further comprising an elastic shock-absorbing element extending to said rear of said upper opposite said fixed abutment of said rear of said upper.

15. A cross-country ski boot according to claim 14, wherein:

said collar is mounted to said upper by means of journals on opposite sides of said upper; and said elastic shock-absorbing element is constituted by a flexible blade that extends over and opposite said fixed abutment by surrounding said rear of said upper, said flexible blade having ends affixed to said collar in areas of said journals, said adjustable support mechanism being mounted on said flexible blade so as to be approximately centered with respect to said journals.

16. A cross-country ski boot according to claim 15, wherein:

said adjustable support mechanism of said retaining device is constituted by said flexible blade, said flexible blade having ends affixed to said collar, and by a tensioning system comprising a lever and a cable capable of retracting said flexible blade from said fixed abutment by separating said flexible blade from said fixed abutment by a certain distance, so as to provide said collar with a possibility of angular movement in said front-to-rear direction, said angular movement in said front-to-rear direction having a limit determined by a recovery of support of said flexible blade on said abutment.

17. A cross-country ski boot according to claim 14, wherein:

said adjustable support mechanism is constituted by a pivotal piece pivotal between said two different positions separated by approximately 180°, said pivotal piece comprising an off-centered portion having a shaped end adapted to cooperate with said fixed abutment of said upper in said first of said two different positions, and to retract from said fixed abutment in said second of said two different positions, thus releasing said collar for pivoting rearwardly from a first to a second of said two skiing positions of said collar.

18. A cross-country ski boot according to claim 14, wherein:

said adjustable support mechanism is constituted of a removable piece that is fixed by elastic pinching on said elastic shock-absorbing element, said removable piece being capable of being adjustably movable between said two different positions separated by 180° on said elastic shock-absorbing element, said removable piece having an approximately U-shape, said U-shape including a first vertical arm markedly thicker than a second vertical arm and cooperating with said fixed abutment of said rear of said upper in said first of said two different positions of said support mechanism, and retracted from said fixed abutment of said rear of said upper by a 180° rotation of said removable piece by placing said second vertical arm opposite said fixed abutment in said second of said two different positions of said support mechanism.

19. A cross-country ski boot according to claim 12, wherein:

said adjustable support mechanism is constituted by a movable lengthening piece guided in said a rear portion of said collar, said lengthening piece being engaged above said fixed abutment of said upper in said first of said two different positions of said support mechanism, and being disengaged from said fixed abutment of said upper in said second of said two different positions of said support mechanism, said disengagement from said fixed abutment of said upper allowing rearward movement of said collar from a first to a second of said two discrete skiing positions of said collar.

20. A cross-country ski boot according to claim 19, wherein:

said movable lengthening piece extends the free end of a flexible tongue fixed rotatably on a of said collar; and said movable lengthening piece is guided through an opening in correspondence with said fixed abutment of said rear of said upper, said disengagement of said lengthening piece from said abutment occurring by retraction of said tongue, followed by lateral rotation with respect to said guiding opening.

21. A cross-country ski boot according to claim 19, wherein:

said movable lengthening piece comprises a maneuvering member accessible from outside said collar and slidable in a slide in a rear portion of said collar between two extreme positions, in one of which said maneuvering member is engaged above said fixed abutment of said upper and in the other of which said maneuvering member is disengaged therefrom.

* * * * *